United States Patent [19]

Piber

[11] 4,055,739

[45] Oct. 25, 1977

[54] LIGHTED TOGGLE LEVER SWITCH

[75] Inventor: Earl T. Piber, Oconomowoc, Wis.

[73] Assignee: Cutler-Hammer, Inc., Milwaukee, Wis.

[21] Appl. No.: 715,897

[22] Filed: Aug. 19, 1976

[51] Int. Cl.[2] ..... H01H 9/16

[52] U.S. Cl. ..... 200/315

[58] Field of Search ..... 200/315; 338/119

[56] References Cited

U.S. PATENT DOCUMENTS

| | | | |
|---|---|---|---|
| 3,301,988 | 1/1967 | Weitzman | 200/315 |
| 3,614,362 | 10/1971 | Keranen | 200/315 |

*Primary Examiner*—Bruce A. Reynolds
*Assistant Examiner*—D. A. Tone
*Attorney, Agent, or Firm*—Hugh R. Rather; William A. Autio; Michael E. Taken

[57] ABSTRACT

A toggle lever switch having a central longitudinal bore in the outer handle for housing an LED (light emitting diode) with terminals extending down through the handle and bent laterally outward along the pivotal axis through lateral holes in the spherical portion of the toggle lever to engage inwardly biased stationary terminals extending up through the bushing adjacently facing the lateral holes. The LED terminals themslves are used as the commutating connectors. Commutation means are provided for spacing the LED terminals and for maintaining good electrical contact with the stationary terminals, and in preferred form comprises an insulating plug having a pigtail. This plug is initially placed at the root of the terminals next to the LED, whereafter the terminals are pinched together in parallel overlapped relation so that they will fit through the bore on the handle and are inserted therethrough until the lateral ends thereof enter the lateral holes and the pigtail comes out through a radial hole extending from the junction of the bore and the lateral holes. The pigtail is then pulled to slide the plug down to spread the lateal ends of the LED terminals and ensure good electrical contact thereof with the stationary terminals.

14 Claims, 3 Drawing Figures

Fig. 1
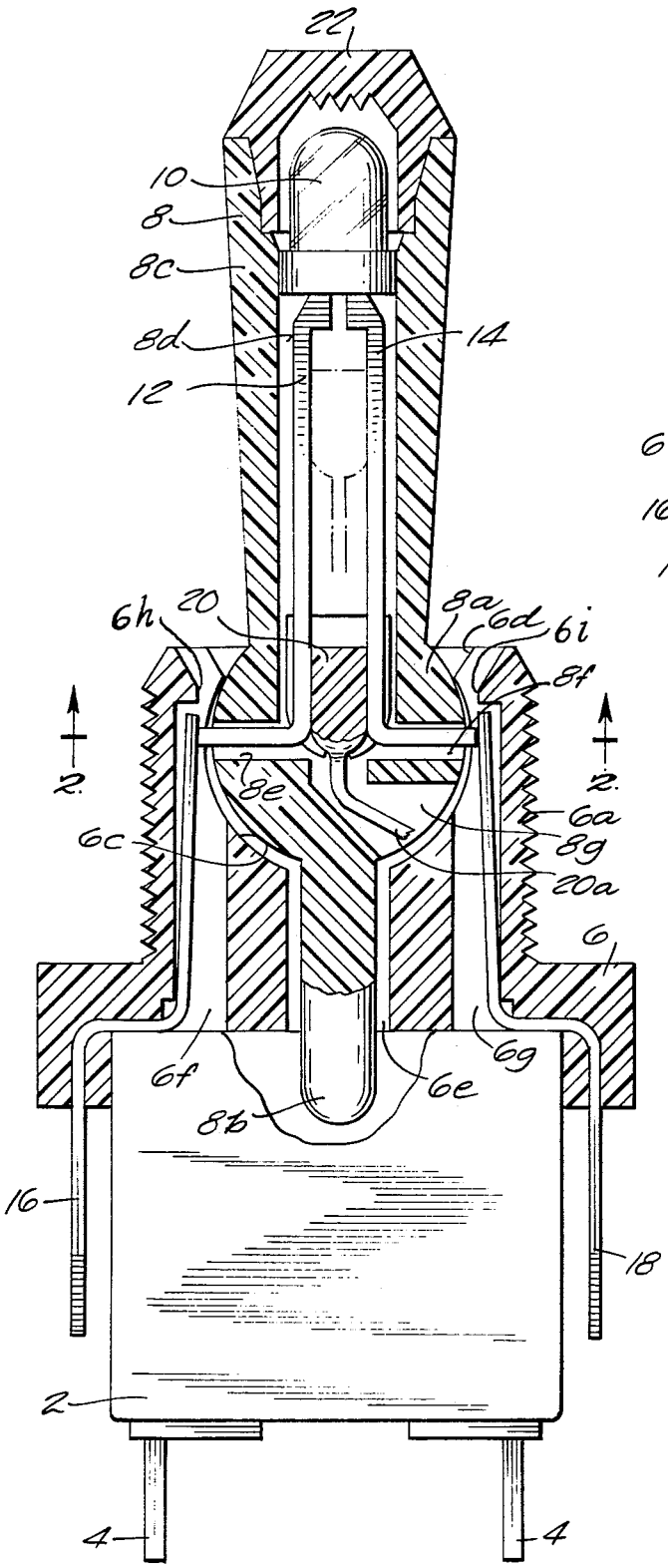
Fig. 2
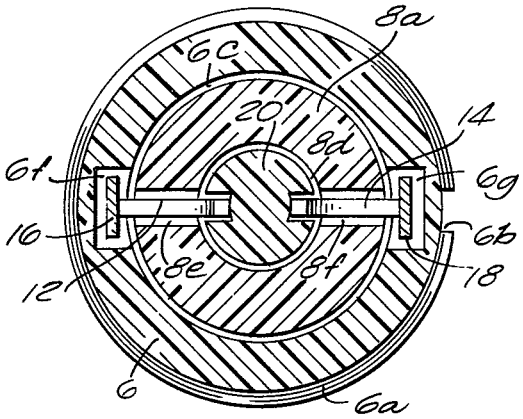
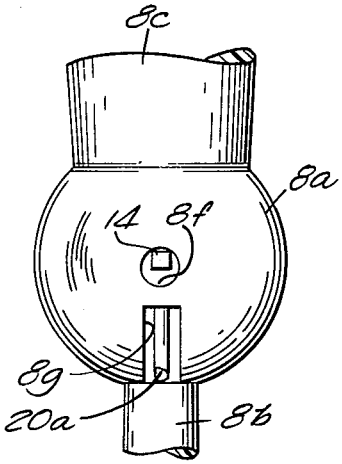
Fig. 3

LIGHTED TOGGLE LEVER SWITCH

BACKGROUND OF THE INVENTION

Lighted toggle lever switches having a lamp in the handle and commutators acting along the pivotal axis have been known theretofore, as disclosed in J. J. Keranen U.S. Pat. No. 3,614,362, dated Oct. 19, 1971, and assigned to the assignee of the present invention. These prior devices, however, have relied upon commutating springs or conductive pins as the commutating connectors along the pivotal axis between the stationary terminals in the base and the lamp terminals in the handle. While such devices have been useful for their intended purposes, the present invention relates to improvements thereover by using the lamp terminals themselves as the commutators without the need for auxiliary connectors.

SUMMARY OF THE INVENTION

An object of the invention is to provide an improved lighted toggle lever switch.

Another object is to provide a switch of the aforementioned character having a light source in or on the handle of the toggle lever with terminals extending down through a central longitudinal bore in the handle and laterally bent outwardly through lateral holes in the pivotally mounted portion of the toggle lever along the pivotal axis thereof to engage stationary terminals in the base of the switch.

Another object is to provide a switch of the aforementioned character wherein the light source terminals themselves are the commutating connectors between the stationary terminals and the light source thereby obviating the need for commutating springs or conductive pins, while still affording the advantages of commutation along the pivotal axis to alleviate problems of wear due to translational sliding or fatique due to flexing of flexible terminals, etc.

Another object is to provide a switch of the aforementioned character further comprising commutation means for ensuring good electrical contact of the light source terminals and the stationary terminals and for keeping the light source terminals spaced apart to prevent short-circuiting of the light source.

Another object is to provide a switch of the aforementioned character wherein said commutation means comprises an insulating member situate in the bore in the handle between the light source terminals.

Another object is to provide a switch of the aforementioned character wherein said insulating member may be resilient.

Another object is to provide a switch of the aforementioned character having a third hole in the toggle lever extending from the junction of the bore and the lateral holes for insertion of the insulating member therethrough or for receiving a tail portion of the insulating member for pulling it down through the bore to spread the light source terminals during assembly.

Another object is to provide a switch of the aforementioned character wherein said commutation means may alternatively comprise resiliency in the light source terminals inherently biasing such terminals outwardly.

Another object is to provide a toggle lever switch illuminated by a light emitting diode in or on the toggle lever handle.

Other objects and advantages will hereinafter appear.

BRIEF DESCRIPTION OF THE DRAWINGS

FIG. 1 is an end view of a lighted toggle lever switch constructed in accordance with the invention with the upper portion including the toggle lever and cover shown in section in the plane of the pivotal axis.

FIG. 2 is a cross-sectional view taken along line 2—2 of FIG. 1.

FIG. 3 is a fragmentary side elevational view of the toggle lever of FIG. 1.

DESCRIPTION OF THE PREFERRED EMBODIMENT

Referring to FIG. 1, the switch is provided with an insulating base 2, terminal means 4, and an insulating cover 6, each of which may be formed as shown and described in said Keranen patent. The base houses switch contacts for actuation by the toggle lever, for example, as described in said Keranen patent.

The open top of the base 2 is closed by the insulating cover 6. Integrally formed with the cover, an externally threaded bushing **6*a* extends up from the center thereof and is provided with a keyway 6*b*, FIG. 2,** along one side thereof for non-rotatably holding a keyed washer when a nut is threaded thereon to mount the switch to a panel.

As shown in FIG. 1, the inside of the bushing is provided with a suitable configuration for snap-in mounting of a toggle lever 8 and for pivotally retaining the toggle lever for movement about a pivotal axis coaxial with section line 2—2, without allowing it to wobble transversely from its proper plane of movement. For this purpose, the bushing has molded therein a socket **6*c* for the spherical portion 8*a* of the toggle lever. The upper sides of this socket diverge to the top of the bushing to form a frusto-conical opening 6*d* through which the shperical portion of the toggle lever may be snapped into its pivotal seat. The lower portion of the bushing below the spherical socket is provided with a reduced opening 6*e* oblong in cross-section to guide the lower end portion 8*b*** of the toggle lever in the plane of its movement.

The toggle lever 8 is an integral opaque insulating member having: a spherical midportion **8*a* seated in socket 6c as aforedescribed; a lower inner end portion 8*b* extending partway down into the upper portion of the base for actuating contact means as aforedescribed; and an upper external end portion 8*c* forming the handle of the toggle lever. Upper portion 8*c* has a central longitudinal bore 8*d* extending from the top thereof down therethrough to communicate with a pair of lateral holes 8*e* and 8*f* along the axis of rotation in midportion 8*a* and also with an obliquely oriented hole 8*g* in portion 8*a*.**

Mounted in bore 8d is a light source, such as a light emitting diode LED 10, which has a pair of terminals 12 and 14 extending downwardly through the bore into spherical portion **8*a* and then bent 90° outwardly to extend through lateral holes 8*e* and 8*f* to engage inwardly biased stationary terminals 16 and 18 extending up through and adjacent the inner side walls of the bushing as shown in FIG. 1.**

Bushing **6*a* is provided with two vertical openings 6*f* and 6*g* therethrough, one on each side, communicating with the lower and upper ends of the bushing and with lateral holes 8*e* and 8*f* in the spherical portion of the toggle lever. Thus stationary terminals 16 and 18 may be inserted up through openings 6*f* and 6*g*, respectively, slightly past the lateral openings and biased inwardly to electrically engage the laterally bent portions of LED terminals 12 and 14, respectively. The stationary terminals have midportions extending laterally through the cover and are then bent downwardly adjacent exterior side walls of the base as shown in FIG. 1**, and also, for example, as shown in said Keranen patent.

During assembly, the LED is first mounted in the toggle lever, the toggle lever is then snapped into the bushing cover 6, and finally the bushing cover is mounted to the base 2. Referring first to installation of the LED, an insulating member, such as a nylon plug 20, is held between terminals 12 and 14, just beneath the LED, shown in dashed line in FIG. 1, while the lower ends of the terminals are pinched together in overlapped relation and inserted from above through bore 8*d*. The length of each of the lateral portions of the LED terminals is less than the width of bore 8*d*, thus making such insertion possible. The nylon plug has a tail portion 20*a* which is threaded through hole 8*g* during assembly. After the LED has been inserted and the lateral portions of terminals 12 and 14 extend through lateral holes 8*e* and 8*f*, the tail is pulled whereby to move plug 20 downwardly through bore 8*d* to the position shown in FIG. 1, thereby holding terminals 12 and 14 against the bias of terminals 16 and 18. The tail may then be cut off at spherical portion 8*a*. A pair of knife blades (not shown) are then inserted into the bushing from below, up into openings 6*f* and 6*g* to hold the upper portions of terminals 16 and 18 in outwardly canted positions against the inner walls of bushing 6*a*, or alternatively, the lower portions of terminals 16 and 18 may be canted inwardly to thereby cant the upper portions outwardly. The toggle lever is then inserted into the bushing from above with the outer ends of the lateral portions of terminals 12 and 14 slipping by nubs 6*h* and 6*i*, respectively, which are formed at the top of openings 6f and 6g to allow clearance of the ends of the LED terminals which protrude from spherical portion 8*a* while the spherical portion is snapped past frustoconical openings 6*d* into socket 6*c*. The knife blades, if used, are then removed and cover 6 is mounted to base 2.

Outer portion 8*c* of the toggle lever may be closed by a transparent cap or lens 22 over the LED, or alternatively, the LED could protrude beyond or be mounted to the end of the toggle lever with no cap thereover.

There are various other ways of inserting plug 20 into bore 8*d*. For example, hole 8*g* may be made larger or otherwise appropriately formed, to allow insertion therethrough of the insulating member from below, without the need for a tail portion.

Energization of the LED requires commutation means to perform the functions of: (i) maintaining good electrical contact between the LED terminals and the stationary terminals; and (ii) spacing the LED terminals to keep them apart and prevent short-circuiting of the LED. In the preferred embodiment, such commutation means comprises the insulating plug. The insulating plug performs the spacing function and also maintains electrical contact of the terminals by providing a stop between the LED terminals against the inward bias of stationary terminals 16 and 18. Other types of commutation means may be used which provide such functions, as will presently be described.

Insulating plug 20 is susceptible of various modifications. For example, it may be made of a resilient material, such as rubber, for biasing terminals 12 and 14 outwardly against terminals 16 and 18, whether or not terminals 16 and 18 are biased inwardly. As another example, the insulating member may have a resilient configuration, such as U-shaped, for biasing terminals 12 and 14 outwardly.

Another alternative is to omit the insulating member altogether and use LED terminals of resilient material inherently biased outwardly to bear against the stationary terminals, whether or not the stationary terminals are inwardly biased. The commutation means may thus comprise inherent resiliency of LED terminals so adapted to provide said functions. The use of an insulating member between the LED terminals is preferred, however, because it provides better contact pressure between the commutating terminals and provides a solid spacing member to positively prevent shorting of the LED without relying on inherent bias of the LED terminals.

It is thus seen that the present invention affords a lighted toggle lever switch having commutators acting along the pivotal axis thereby obviating problems of wear due to translational sliding or fatique due to flexing of flexible terminals, etc. The invention further affords the use of the LED terminals themselves as the commutating connectors extending along the pivotal axis thereby obviating the need for commutating springs, conductive pins, etc., as connectors. Commutation means are provided for spacing the LED terminals and for ensuring good electrical contact with the stationary terminals in the base.

The present invention is not to be confined to the particular structures hereinbefore described, inasmuch as it is susceptible of various modifications without departing from the scope of the appended claims.

I claim:

1. In a switch having a housing enclosing contacts, the combination comprising:

a bushing at the top of said housing;

a toggle lever extending through said bushing and having a middle portion pivotally mounted in said bushing, an inner portion for operating said contacts, and an outer portion having a central bore extending longitudinally therethrough to communicate with a pair of lateral holes extending oppositely outwardly through said middle portion coaxial with the pivotal axis of said toggle lever;

a pair of stationary terminals extending up through said bushing adjacent the outer ends of said lateral holes;

a light source having a pair of terminals extending longitudinally in said bore with bent portions extending laterally outwardly through said lateral holes to engage said stationary terminals, and means maintaining electrical contact between said stationary terminals and said bent portions of said light source terminals and maintaining said light source terminals in spaced-apart relation to prevent shorting of said light source.

2. The switch according to claim 1 wherein said means comprises an insulating member situate in said bore between said light source terminals.

3. The switch according to claim 2 wherein said middle portion of said toggle lever has a third hole extending outwardly from the junction of said bore and said lateral holes, and wherein said insulating member has a tail portion in said third hole.

4. The switch according to claim 2 wherein said insulating member resiliently biases said light source terminals laterally outwardly to provide electrical contact between said bent portions and said stationary terminals.

5. The switch according to claim 2 wherein said middle portion has a third hole extending outwardly from the junction of said bore and said lateral holes for insertion of said insulating member through said third hole into said bore between said light source terminals.

6. The switch according to claim 1 wherein the length of each of said bent portions of said light source terminals is less than the width of said longitudinal bore whereby said light source terminals may be inserted into said bore from the outer end thereof.

7. The switch according to claim 1 wherein said means comprises inherent resiliency in said light source terminals biasing said bent portions laterally outwardly.

8. The switch according to claim 1 wherein said stationary terminals are laterally inwardly biased against said bent portions of said light source terminals.

9. The switch according to claim 1 wherein said light source is a light emitting diode.

10. The switch according to claim 9 wherein said diode is mounted in said bore and wherein said switch further comprises a light-transmissive cap mounted to the outer end of said outer portion of said toggle lever.

11. The switch according to claim 9 wherein said diode is mounted in said bore and protrudes beyond the outer end of said outer portion of said toggle lever.

12. The switch according to claim 9 wherein said diode is mounted to the outer end of said outer portion of said toggle lever.

13. The switch according to claim 1 wherein the length of each of said bent portions of said light source terminals is less than the width of said bore whereby said light source terminals may be laterally deflected for insertion into said bore from the outer end thereof, and wherein said means comprises an insulating member situate in said bore between said light source terminals proximate said lateral holes.

14. The switch according to claim 13 wherein said middle portion of said toggle lever has a third hold extending outwardly from the junction of said bore and said lateral holes, and wherein said insulating member has a tail portion threadable through said third hole during assembly such that said insulating member may be disposed adjacent said light source during insertion of said light source terminals into said bore, whereafter said tail portion may be pulled to slide said insulating member longitudinally in said bore to a position proximate said lateral holes.

* * * * *